US006733315B2

(12) United States Patent
Linhart

(10) Patent No.: US 6,733,315 B2
(45) Date of Patent: May 11, 2004

(54) VACUUM CLEANER HOSE WITH THE CONNECTION SLEEVE

(75) Inventor: Georg Peter Linhart, Wöllstadt (DE)

(73) Assignee: Truplast Kunststotttechnik GmbH, Langgons (DE)

( * ) Notice: Subject to any disclaimer, the term of this patent is extended or adjusted under 35 U.S.C. 154(b) by 34 days.

(21) Appl. No.: 10/238,815

(22) Filed: Sep. 10, 2002

(65) Prior Publication Data

US 2003/0073334 A1 Apr. 17, 2003

(30) Foreign Application Priority Data

Sep. 10, 2001 (DE) ..... 201 14 936 U

(51) Int. Cl.[7] ..... H01R 4/60
(52) U.S. Cl. ..... 439/191
(58) Field of Search ..... 439/191, 192, 439/193, 194

(56) References Cited

U.S. PATENT DOCUMENTS 4,345,805 A * 8/1982 Finley et al. ..... 439/191

6,015,298 A * 1/2000 Linhart ..... 439/24

* cited by examiner

*Primary Examiner*—Neil Abrams
*Assistant Examiner*—Phuong Dinh
(74) *Attorney, Agent, or Firm*—Horst M. Kasper

(57) ABSTRACT

A vacuum unit cleaner hose having a hose (1), a connection sleeve (4), and a rear connection part (4*a*) of the sleeve (4) partially engaging into the hose (1) and exhibiting an axial slot (4*b*) starting from a rearward end of the rear connection part (4*a*). Electrical conductors (3) are led out of the front section of the rear connection part (4*a*), wherein the hose (1) does not cover the front section of the rear connection part (4*a*). A protective envelope (2) for the electric conductors (3) is attached at the inner wall of the hose (1). Flanks of the rear connection part (4*a*) transition into the projection (4*c*) formed for the receiving of a coordinated end of the protective envelope (2) as well as closed at the front end. An axial slot (4*b*) is formed in the connection sleeve (4). A cover (7) has an apex and bridges over part of a length of the axial slot (4*b*), wherein the cover (7) exhibits side walls (7*a*) formed for engaging into the projection (4*c*) and wherein the cover (7) exhibits a head wall (7*b*) connecting the side walls (7*a*).

7 Claims, 1 Drawing Sheet

VACUUM CLEANER HOSE WITH THE CONNECTION SLEEVE

BACKGROUND OF THE INVENTION

1. Field of the Invention

The invention relates to a vacuum cleaner hose with a connection sleeve that contains a protective envelope for electrical conductors attached at the inner wall of the hose and a rear connection part of the sleeve partially engaging into the hose. The connection part exhibits an axial slot starting from the rear end of the connection part, in which the flanks transition into a projection formed for the receiving of the coordinated end of the protective sleeve as well as closed at its front end, from which electrical conductors are led from the front section of the rear connection part not covered by the hose.

2. Brief Description of the Background of the Invention Including Prior Art

A vacuum cleaner hose with connection sleeve is already known. The rear connection part here is not rendered as stiff as a connection part based on the axial slot disposed at the rear connection part, wherein the jacket of the connection part is closed without interruption circumferentially and therefore sealing failures can be generated between the hose and the rear connection part in unfavorable situations. On the other hand, it is favorable when the projection is open at the top, since then the electrical conductors can be easier laid into the projection.

SUMMARY OF THE INVENTION

1. Purposes of the Invention

It is an object of the invention to form a back to the cleaner hose with connection sleeve; such that the axial slot in the rear connection part remains maintained because of the alleviated insertion of the electrical conductor into the projection, and nevertheless a radial stiffness of the rear connection part is accomplished which stiffness equals to a connection part close circumferentially.

These and other objects and advantages of the present invention will become evident from the description which follows.

2. Brief Description of the Invention

The present invention provides a construction associated with the advantage that a loosely inserted cover, for opening and closing of the hollow space of the projection, can be removed at any time from the axial slot and can be placed back into the axial slot.

The novel features which are considered as characteristic for the invention are set forth in the appended claims. The invention itself, however, both as to its construction and its method of operation, together with additional objects and advantages thereof, will be best understood from the following description of a specific embodiment when read in connection with the accompanying drawing. An embodiment of the invention is schematically illustrated in the drawing.

BRIEF DESCRIPTION OF THE DRAWING

In the accompanying drawing, in which is shown one of the various possible embodiments of the present invention.

DESCRIPTION OF INVENTION AND PREFERRED EMBODIMENT

Figure 1:
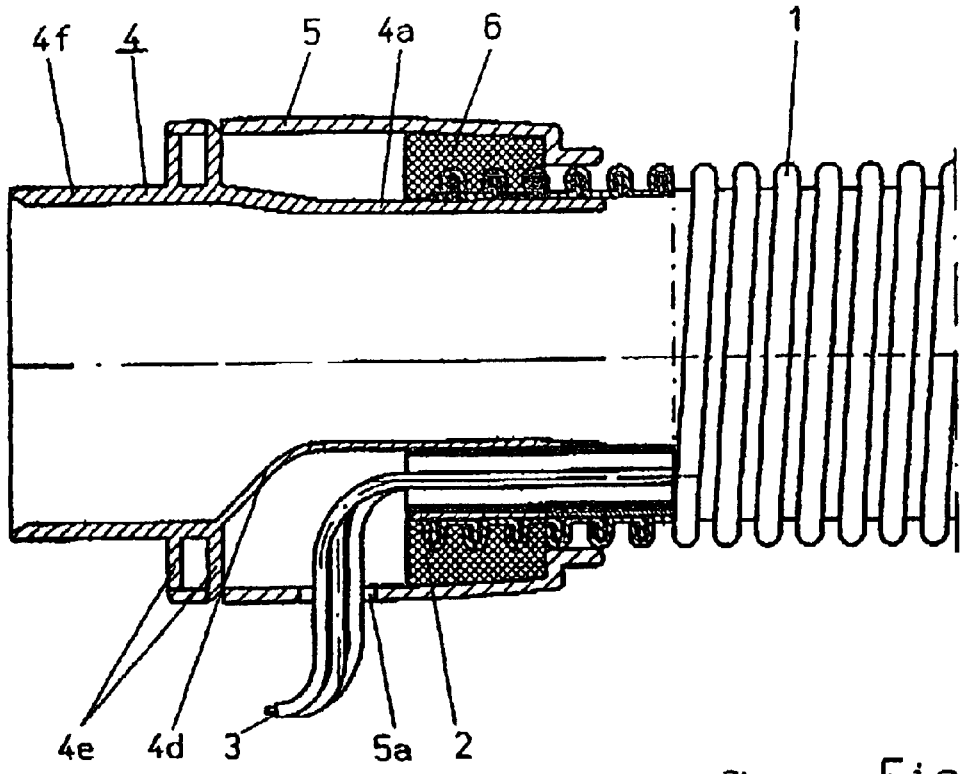
FIG. 1 is a side elevational and in part sectional view of a vacuum cleaner hose with a connection sleeve.

A vacuum cleaner hose is designated with reference numeral 1, wherein the surface of the hose is smooth on the inside and exhibits helically shaped running waves valleys and wave mountains.

A protective envelope 2 for electrical conductors 3 is attached at least at some positions at the inner wall of the hose 1. The protective envelope 2 is in the example illustrated as an elastic hose having a round cross-section.

Figure 2:
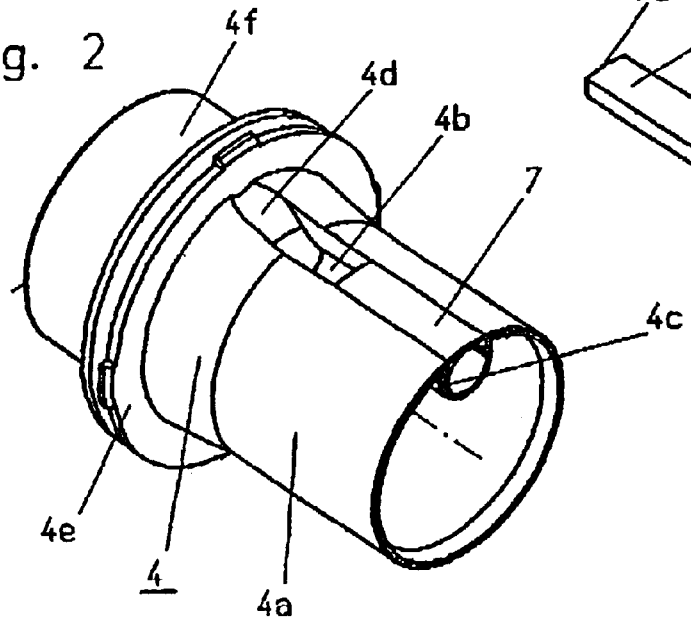
FIG. 2 is a perspective view of a connection sleeve.
Figure 3:
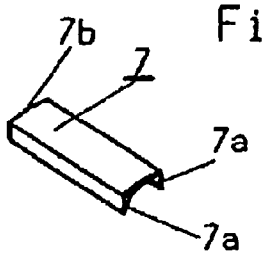
FIG. 3 is a perspective view of a cover.

A rear connection part 4*a* of a connection sleeve 4 partially engaging into the hose 1 exhibits an axial slot 4*b* (FIG. 2) starting at the rearward end of the hose 1, wherein the flanks of the axial slot 4*b* transition into a projection 4*c*, wherein the projection 4*c* is formed for receiving the coordinated end of the protective envelope 2. The projection 4*c* is delimited and closed at its front end by a wall 4*d* running bow shaped relative to the axial slot 4*b* (FIGS. 1 and 2).

The electrical conductors 3 are led out of the front section of the rear connection part 4*a* of the connection sleeve 4 not covered by the hose 1. The electrical conductors 3 furthermore grip through a recess 5 of an outer bush 5 (FIG. 1); wherein the outer bush 5 is connected to a collar 4*e* formed at the connection sleeve 4. A front connection part 4*f* of the connection sleeve 4 is disposed at the front side of the collar 4*e*. The rear end of the outer bush 5 grips behind an intermediate ring 6 (FIG. 1), wherein the intermediate ring 6 is screwed onto the hose 1 or is molded to the hose 1.

The axial slot 4*b* is bridged over a part of the length of the axial slot 4*b* by a cover 7. This cover 7 exhibits two side walls 7*a* formed for engaging into the projection 4*c* and further exhibits a front wall 7*b*. The outer contour of the front wall 7*b* is adapted to the circular shape of the rear connection part 4*a* of the sleeve 4.

In order to be able to slide the rear connection part 4*a* together with the head wall 7*b* of the cover 7 into the hose 1 without hindrance, the protective envelope 2 is disengaged over part of the length of the protective envelope from the inner side of the hose.

The cover 7 rests in its destined position with its rear end at the same level as the rearward end of connection part 4*a* of the sleeve 4. An at-least-sufficient distance for the leading out of the electrical conductors 3 out of the rear connection part 4*a* is furnished in contrast between the front side of the cover 7 and the front, closed end of the axial slot 4*b*. The cover 7 can be adhesively attached into the projection 4*c* or can be molded to or welded to the projection 4*c*.

It will be understood that each of the elements described above, or two or more together, may also find a useful application in other types of cleaning system configurations and gas exhausting procedures differing from the types described above.

While the invention has been illustrated and described as embodied in the context of a vacuum cleaner hose with the connection sleeve, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

What is claimed is:

1. A vacuum unit cleaner hose with a connection sleeve comprising:

a) a protective envelope (2) for electric conductors (3) is attached at the inner wall of the hose (1);

b) a rear connection part (4*a*) of the sleeve (4) partially engaging into the hose (1) exhibits an axial slot (4*b*) starting from the rearward end of the rear connection part (4*a*), wherein the flanks of the rear connection part (4*a*) transition into a projection (4*c*) formed for the receiving of the coordinated end of the protective envelope (2) as well as closed at the front end;

c) wherein the electrical conductors (3) are led out of the front section of the rear connection part (4*a*), wherein the hose (1) does not cover the front section of the rear connection part (4*a*);

d) the axial slot (4*b*) is bridged over part of the length of the axial slot (4*b*) by a cover (7), wherein the cover exhibits side walls (7*a*) formed for engaging into the projection (4*c*) and exhibits a head wall (7*b*) connecting the side walls (7*a*), wherein the outer contour of the head wall (7*b*) is adapted to the circular shape of the rear connection part (4*a*);

e) the protective envelope (2) is disengaged from the inner side of the hose over part of the length of the protective envelope (2) for allowing an unimpeded insertion of the apex of the cover into the hose (1).

2. The vacuum cleaner hose according to claim 1 wherein the cover (7) in its destined position rests with the rearward end of the cover (7) at the same level as the rearward end of the rear connection part (4*a*) and wherein an at least sufficient distance for the leading out of the electrical conductors (3) from the rear connection part (4*a*) is furnished between the front side of the cover (7) and the front, closed end of the axial slot (4*b*).

3. The vacuum cleaner hose according to claim 1 wherein the side walls (7*a*) of the cover (7) are adhesively attached into the projection (4*c*) or are welded in.

4. A vacuum unit cleaner hose comprising:

a hose (1) having an inner wall;

a connection sleeve (4);

a rear connection part (4*a*) of the sleeve (4) partially engaging into the hose (1) and exhibiting an axial slot (4*b*) starting from a rearward end of the rear connection part (4*a*);

electrical conductors (3), wherein the electrical conductors (3) are led out of a front section of the rear connection part (4*a*), wherein the hose (1) does not cover the front section of the rear connection part (4*a*);

a protective envelope (2) for the electric conductors (3) is attached at the inner wall of the hose (1);

a projection (4*c*), wherein flanks of the rear connection part (4*a*) transition into the projection (4*c*) formed for a receiving of a coordinated end of the protective envelope (2) as well as closed at a front end;

an axial slot (4*b*) formed in the connection sleeve (4);

a cover (7) having an apex and bridging over part of a length of the axial slot (4*b*), wherein the cover (7) exhibits side walls (7*a*) formed for engaging into the projection (4*c*) and wherein the cover (7) exhibits a head wall (7*b*) connecting the side walls (7*a*), wherein the outer contour of the head wall (7*b*) is adapted to the circular shape of the rear connection part (4*a*), and wherein the protective envelope (2) is disengaged from the inner side of the hose over part of the length of the protective envelope (2) for allowing an unimpeded insertion of the apex of the cover into the hose (1).

5. The vacuum cleaner hose according to claim 4 wherein the cover (7) in a destined position rests with a rearward end of the cover (7) at a same level as the rearward end of the rear connection part (4*a*) and wherein an at least sufficient distance for the leading out of the electrical conductors (3) from the rear connection part (4*a*) is furnished between a front side of the cover (7) and a front, closed end of the axial slot (4*b*).

6. The vacuum cleaner hose according to claim 4 wherein the side walls (7*a*) of the cover (7) are adhesively attached into the projection (4*c*).

7. The vacuum cleaner hose according to claim 4 wherein the side walls (7*a*) of the cover (7) are welded to the projection (4*c*).

* * * * *